US009193562B2

(12) United States Patent
Chen

(10) Patent No.: US 9,193,562 B2
(45) Date of Patent: Nov. 24, 2015

(54) UNIVERSAL REEL DEVICE

(71) Applicants: Yi-Chen Chen, Taipei (TW); Dong Guan Top Den Electronics Limited Company, Dongguan (CN)

(72) Inventor: Yi-Chen Chen, Taipei (TW)

(73) Assignees: Yi-Chen Chen, Taipei (TW); Dong Guan Top Den Electronics Limited Company, Dongguan (CN)

( * ) Notice: Subject to any disclaimer, the term of this patent is extended or adjusted under 35 U.S.C. 154(b) by 197 days.

(21) Appl. No.: 13/953,037

(22) Filed: Jul. 29, 2013

(65) Prior Publication Data

US 2014/0151486 A1 Jun. 5, 2014

(30) Foreign Application Priority Data

Nov. 30, 2012 (CN) ..... 2012 2 0647783 U

(51) Int. Cl.
*B65H 75/28* (2006.01)
*B65H 75/44* (2006.01)

(52) U.S. Cl.
CPC .... *B65H 75/4434* (2013.01); *B65H 2701/3919* (2013.01)

(58) Field of Classification Search
CPC .... B65H 75/28; B65H 75/48; B65H 75/4431; B65H 75/4434
USPC ..... 242/378, 378.1–378.4; 191/12.2 R
See application file for complete search history.

(56) References Cited

U.S. PATENT DOCUMENTS

| | | | | |
|---|---|---|---|---|
| 7,384,013 | B2 * | 6/2008 | Yen | 242/378 |
| 7,523,883 | B2 * | 4/2009 | Cheng | 242/378 |
| 7,604,194 | B2 * | 10/2009 | Chang | 242/378.1 |
| 8,870,111 | B2 * | 10/2014 | Kwankijpongsa et al. | 242/378 |
| 2011/0062268 | A1 * | 3/2011 | Cheng | 242/378.1 |
| 2011/0139918 | A1 * | 6/2011 | Chen | 242/371 |

* cited by examiner

*Primary Examiner* — Sang Kim
(74) *Attorney, Agent, or Firm* — C. G. Mersereau; Nikolai & Mersereau, P.A.

(57) ABSTRACT

A universal reel device includes an upper cover and a lower cover fastened together, a spool, a spiral spring and a safety switch for locking the spool. The spool has a bottom layer, a middle layer and a top layer. The middle layer is an annular cable distributing disk having a cable hooking slot. A bottom portion of the bottom layer is formed with a planar track and a U-shaped movable tongue for positioning is disposed between the bottom layer and the lower cover. The universal reel device can reel in various cable products, and may also be combined with a cable to form a single-pull or dual-pull reel. In use, a safety switch is used to lock the spool. The spool cannot rotate until the user unlocks the safety switch so that the high safety feature is obtained.

24 Claims, 11 Drawing Sheets

UNIVERSAL REEL DEVICE

BACKGROUND OF THE INVENTION (1) Field of the Invention

The invention relates to a cable reel device, and more particularly to a universal reel device for storing cables of various electronic apparatuses, wherein the universal reel device can be combined with a cable to form a single-pull reel or a dual-pull reel.

(2) Description of the Prior Art

As is well known in the art, products including a wired earphone, a mouse, a keyboard, a charger and the like have to obtain information, transmit information or be powered through a cable such as a data transmission cable. Alternatively, a key ring, stationery and accessory can be reeled in and out through a simple cable connected thereto. In the early period, the cable is usually wound or irregularly collected. However, the irregular cable tends to intertwine so that the use becomes awry. Thus, many designers sequentially design many structures and products on the reel-in and reel-out functions of such a kind of cables. Such kind of product mainly has a spiral spring serving as a main body, and the elastic winding force of the spiral spring reels in the cable according to a helical path or an annular path. When the cable is pulled out, the outward extending latching force of the spiral spring slightly restricts the operation of pulling out the cable. However, the restricting force still can be easily overcome. Thus, the cable being reeled in and out has a track path and encounters the restricted force, so that the cable can be smoothly reeled in and out.

However, the above-mentioned cable reels have the cables therein. That is, one end of the cable of the product, such as the earphone, the mouse, the keyboard, the charger and the like, needs to be fixed to the cable reel, and one cable reel only can be applied to only one product, thereby restricting the used range of the cable reel. In addition, when the existing cable reel is being used and the cable or the cable reel is unintentionally or accidentally touched, the cable reel tends to enter the automatic reel-in state and the elastic winding force of the spiral spring is instantaneously released, and the product connected to the cable suddenly bounces to hurt the user. Thus, the safety is not high.

SUMMARY OF THE INVENTION

An object of the invention is to provide a universal reel device for solving the lack of the existing art so that the user can freely reel in or release various cable products and the convenience in use can be significantly enhanced.

Another object of the invention is to provide a universal reel device for solving the lack of the existing art so that the user can freely lock the spool according to the used condition and the automatic reel-in of the cable caused by the careless operation can be avoided to enhance the safety in use.

Yet still another object of the invention is to provide a universal reel device for solving the lack of the existing art so that the universal reel device of the invention can be combined with the cable to form a single-pull reel or dual-pull reel with the high safety.

To achieve the above-identified objects, the invention provides a universal reel device comprising an upper cover, a lower cover, a spool and a spiral spring. The upper cover and the lower cover are fastened together. A center of the lower cover projects upwards to form a shaft. A center of the spool is formed with a through hole matching with the shaft. The shaft is inserted into the through hole so that the spool is rotatably mounted between the upper cover and the lower cover. The spool comprises, from bottom to top, a bottom layer, a middle layer and a top layer. A top portion of the top layer projects upwards to form a convex block for locking the spiral spring. The middle layer is an annular cable distributing disk. The cable distributing disk has a cable hooking slot for hooking a cable. Each of an outer side of the upper cover and an outer side of the lower cover is formed with an opening, which is for placement of the cable and corresponds to the cable hooking slot. A U-shaped movable tongue for positioning is disposed between the bottom layer and the lower cover. An inner side of the lower cover is formed with a U-shaped position restricting slot matching with the U-shaped movable tongue. A middle of an arced path of the U-shaped movable tongue is formed with an upwardly projecting tongue member. A bottom portion of the bottom layer is formed with a planar track for movement of the tongue member, the tongue member is fit into the planar track so that the spool can drive the tongue member through the planar track and thus drive the U-shaped movable tongue to move in the U-shaped position restricting slot. The universal reel device further comprises a safety switch for locking the spool manually.

Preferably, the planar track comprises an inner ring track, an outer ring track and a positioning portion, which is disposed between the inner ring track and the outer ring track and is for engaging and positioning of the tongue member.

Preferably, the bottom portion of the bottom layer is formed with a central projection, an edge projection, a partition projection and a positioning projection, which project downwardly to form the planar track; the partition projection is annular to partition off the inner ring track from the outer ring track; the partition projection is formed with a notch, the positioning projection has a heart-like shape, and the positioning projection is located at the notch of the partition projection; and the edge projection is located at a junction between the inner ring track and the outer ring track.

Preferably, the safety switch comprises an actuating block and an elastic sheet; the upper cover is formed with a placement hole; the actuating block and the elastic sheet are disposed in the placement hole, and one end of the elastic sheet rests against an inner wall of the placement hole; the other end of the elastic sheet rests against the actuating block; an outer side of the convex block of the top layer is formed with a latch slot; a bottom portion of the actuating block is formed with an engaging block, which matches with the latch slot and is for engaging with the spool; and a top portion of the actuating block projects beyond the placement hole.

Still preferably, the safety switch comprises a U-shaped latch and a push-pull portion for latching the U-shaped movable tongue, wherein the U-shaped latch is connected to the push-pull portion through a link, the U-shaped latch is disposed in the lower cover, the push-pull portion is disposed outside the lower cover, the lower cover is formed with a hole through which the link passes; and when the push-pull portion pushes the U-shaped latch into the U-shaped position restricting slot, the U-shaped latch latches the U-shaped movable tongue to lock the spool.

Preferably, two sides of the opening are formed with two cable slots having boundary portions corresponding to the cable distributing disk.

Preferably, a glue stick, a velcro, a metal sheet or a magnet sheet is disposed on a bottom end of the lower cover.

Preferably, a hanging object is disposed on corresponding outer sides of the upper cover and the lower cover, wherein an adhesive film is disposed on a surface of the hanging object, the adhesive film is a metal sheet or a magnet sheet, and two sides of the adhesive film are formed with longitudinal depressed slots for embedding and fixing the cable.

Preferably, the universal reel device of the invention further comprises the cable to form a single-pull reel. One end of the cable is fixed to the spool of the universal reel device; and the other end of the cable is a free end disposed outside the universal reel device.

Preferably, the universal reel device of the invention also further comprises the cable to form a dual-pull reel. A middle portion of the cable is fixed to the spool of the universal reel device, and two ends of the cable are free ends disposed outside the universal reel device.

The advantageous effect of the invention resides in that the universal reel device of the invention includes the upper cover, the lower cover, the spool and the spiral spring. The spool comprises, from bottom to top, the bottom layer, the middle layer and the top layer. The top portion of the top layer projects upwards to form the convex block for locking the spiral spring. The middle layer is the annular cable distributing disk. The cable distributing disk has the cable hooking slot for hooking the cable. Each of the outer side of the upper cover and the outer side of the lower cover is formed with the opening, which is for placement of the cable and corresponds to the cable hooking slot. The U-shaped movable tongue for positioning is disposed between the bottom layer and the lower cover. The inner side of the lower cover is formed with the U-shaped position restricting slot matching with the U-shaped movable tongue. The bottom portion of the bottom layer is formed with the planar track for movement of the tongue member. The universal reel device further comprises the safety switch for locking the spool manually. In use, the user can hang the cable of the cable product (e.g., the earphone, the charger and the like) in the cable hooking slot through the opening, and then the rotation of the spool reels in the cable of the cable product so that the universal reel device can be implemented. That is, the universal reel device of the invention can be applied to and used in conjunction with various cable products. In addition, the safety switch of the universal reel device of the invention can manually lock the spool, and the spool cannot rotate until the user manually unlocks the safety switch. Thus, it is possible to prevent the reel device from entering the automatic reel-in state when the cable or the reel device is unintentionally or accidentally touched. In the automatic reel-in state, the product connected to the cable suddenly bounces to hurt the user. Thus, the safety can be enhanced. So, the universal reel device of the invention has the feature of the high safety.

Similarly, in the single-pull reel combined with the universal reel device of the invention, the safety switch can manually lock the spool, and the spool cannot rotate until the user manually unlocks the safety switch. Thus, it is possible to prevent the single-pull reel from entering the automatic reel-in state when the cable or the reel device is unintentionally or accidentally touched. In the automatic reel-in state, the product connected to the cable suddenly bounces to hurt the user. Thus, the safety can be enhanced. So, the single-pull reel of the invention also has the feature of the high safety.

Similarly, in the dual-pull reel combined with the universal reel device of the invention, the safety switch can manually lock the spool, and the spool cannot rotate until the user manually unlocks the safety switch. Thus, it is possible to prevent the dual-pull reel from entering the automatic reel-in state when the cable or the reel device is unintentionally or accidentally touched. In the automatic reel-in state, the product connected to the cable suddenly bounces to hurt the user. Thus, the safety can be enhanced. So, the dual-pull reel of the invention also has the feature of the high safety.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
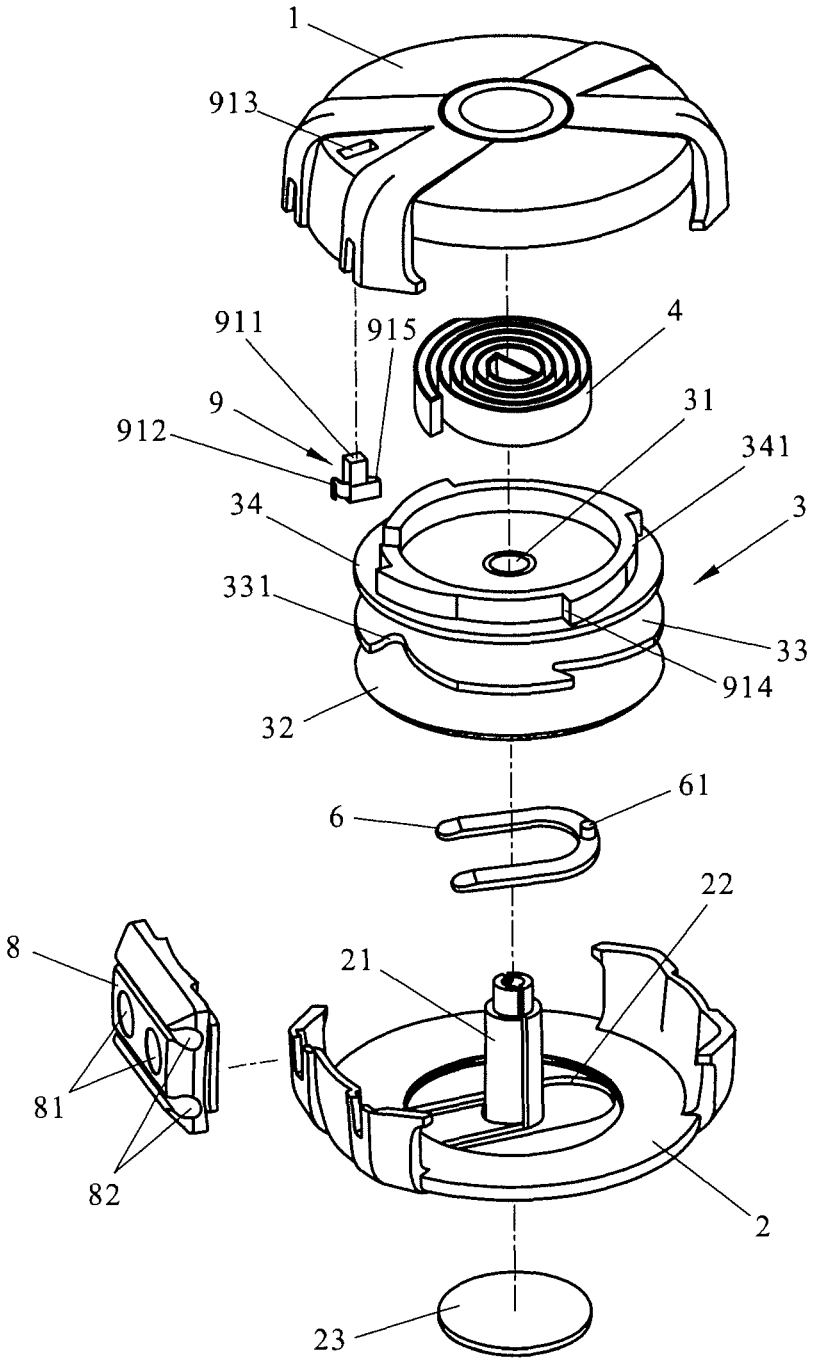
FIG. 1 is a decomposed schematic illustration showing a universal reel device according to a first embodiment of the invention.
Figure 2:
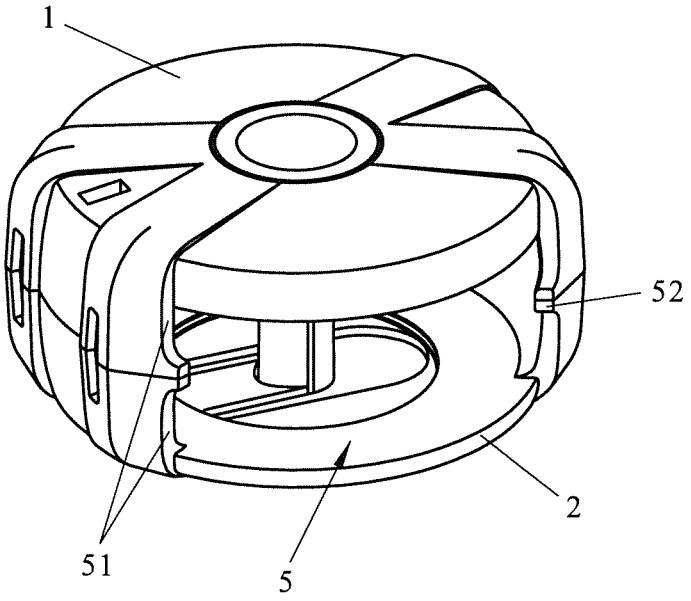
FIG. 2 is a schematic illustration showing structures of an upper cover and a lower cover of the universal reel device according to the first embodiment of the invention.
Figure 3:
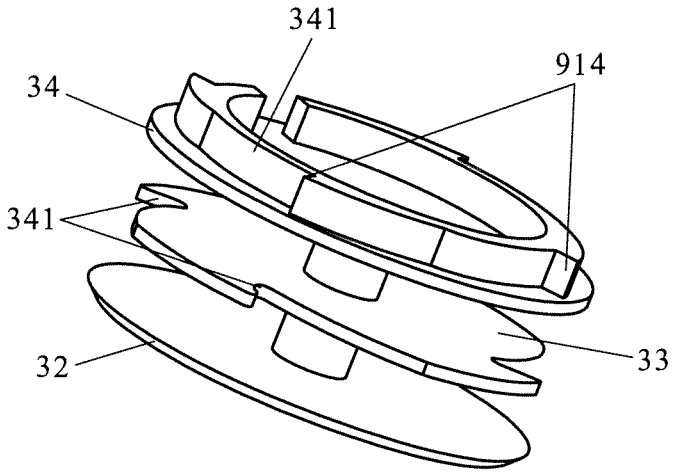
FIG. 3 is a schematic illustration showing a structure of a spool of the universal reel device according to the first embodiment of the invention.
Figure 4:
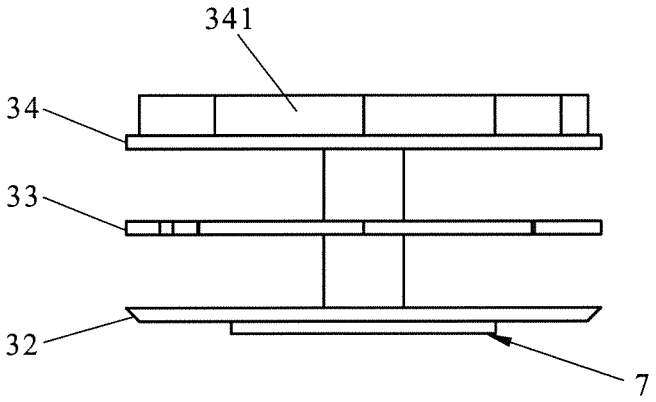
FIG. 4 is a side view of FIG. 3.

The invention will be described in detail with reference to the accompanying drawings.

First Embodiment

Referring to FIGS. 1 to 10, the universal reel device of the invention includes an upper cover 1, a lower cover 2, a spool 3 and a spiral spring 4. The upper cover 1 and the lower cover 2 are fastened together. The center of the lower cover 2 projects upwards to form a shaft 21. The center of the spool 3 is formed with a through hole 31 matching with the shaft 21. The shaft 21 is inserted into the through hole 31 so that the spool 3 is rotatably mounted between the upper cover 1 and the lower cover 2. The spool 3 includes, from bottom to top, a bottom layer 32, a middle layer and a top layer 34. The top portion of the top layer 34 projects upwards to form a convex block 341 for locking the spiral spring 4. Because the structure of locking the spiral spring 4 to the spool 3 pertains to the prior art, detailed descriptions thereof will be omitted. The middle layer is an annular cable distributing disk 33 having a cable hooking slot 331 for hooking a cable. Such the structure of the cable distributing disk 33 can make the external cable reeled by the spool 3 be distributed outside two sides of the cable distributing disk 33 in an orderly and average manner, and can further reduce the friction between each part of the universal reel device of the invention and the reeled external cable. The one or multiple cable hooking slots 331 on the cable distributing disk 33 may also become firmer, more strengthened and cannot be easily broken due to the compact structure of the cable distributing disk 33 of the spool 3. In addition, the cable hooking slot 331 also facilitate the user in actuating the spool 3 by the hand to make the spiral spring 4 become the shrinkage state. Each of the outer side of the upper cover 1 and the outer side of the lower cover 2 (i.e., the outer sides of the upper cover 1 and the lower cover 2 fastened to form the housing) is formed with an opening 5, which is for placement of the cable and corresponds the cable hooking slot 331 to facilitate the user in hooking the cable of the cable product in the cable hooking slot 331 through the opening 5.

A U-shaped movable tongue 6 for positioning is disposed between the bottom layer 32 and the lower cover 2. The inner side of the lower cover 2 is formed with a U-shaped position restricting slot 22 matching with the U-shaped movable tongue 6. A middle of an arced path of the U-shaped movable tongue 6 is formed with an upwardly projecting tongue member 61. That is, the tongue member 61 is fixed to a top end of a middle of an arced path of the U-shaped movable tongue 6, so that the U-shaped movable tongue 6 upon movement has the better balance. The bottom portion of the bottom layer 32 is formed with a planar track 7 for movement of the tongue member 61. The tongue member 61 is fit into the planar track 7, so that the spool 3 can drive the tongue member 61 through the planar track 7 and thus drive the U-shaped movable tongue 6 to move in the U-shaped position restricting slot 22. That is, when the tongue member 61 moves in the planar track 7, the U-shaped movable tongue 6 slides in the U-shaped position restricting slot 22.

The universal reel device further includes a safety switch 9 for manually locking the spool 3. That is, the safety switch 9 manually locks the spool 3, and only the user can manually unlock the safety switch 9 so that the spool 3 can rotate. Otherwise, when the safety switch 9 is in the locked state, the spool 3 cannot rotate.

Specifically, the planar track 7 includes an inner ring track 71, an outer ring track 72, and a positioning portion 73, which is disposed between the inner ring track 71 and the outer ring track 72 and is for engaging and positioning of the tongue member 61. Because the planar track 7 is adopted in this invention, no step is formed between the inner ring track 71 and the outer ring track 72 of the planar track 7, so that the sound is very small when the tongue member 61 is moving in the planar track 7 and the sound interference can be eliminated. Furthermore, compared with the conventional cable reel device using a steel ball as the tongue, the friction of the U-shaped movable tongue 6 in the overall device is reduced so that the endurability of the overall apparatus can be lengthened because the larger engaging space may be formed between the U-shaped movable tongue 6 and the planar track 7 of the invention, and the U-shaped movable tongue 6 of the invention can be made of the plastic material, which is the same as the material of the planar track 7 of the spool 3 and the U-shaped position restricting slot 22.

More specifically, the bottom portion of the bottom layer 32 is formed with a central projection 321, an edge projection 322, a partition projection 323 and a positioning projection 324, which project downwardly to form the planar track 7. The partition projection 323 is annular to partition off the inner ring track 71 from the outer ring track 72. The partition projection 323 is formed with a notch, the positioning projection 324 has a heart-like shape, and the positioning projection 324 is located at the notch of the partition projection 323. The edge projection 322 is located at the junction between the inner ring track 71 and the outer ring track 72.

Figure 5:
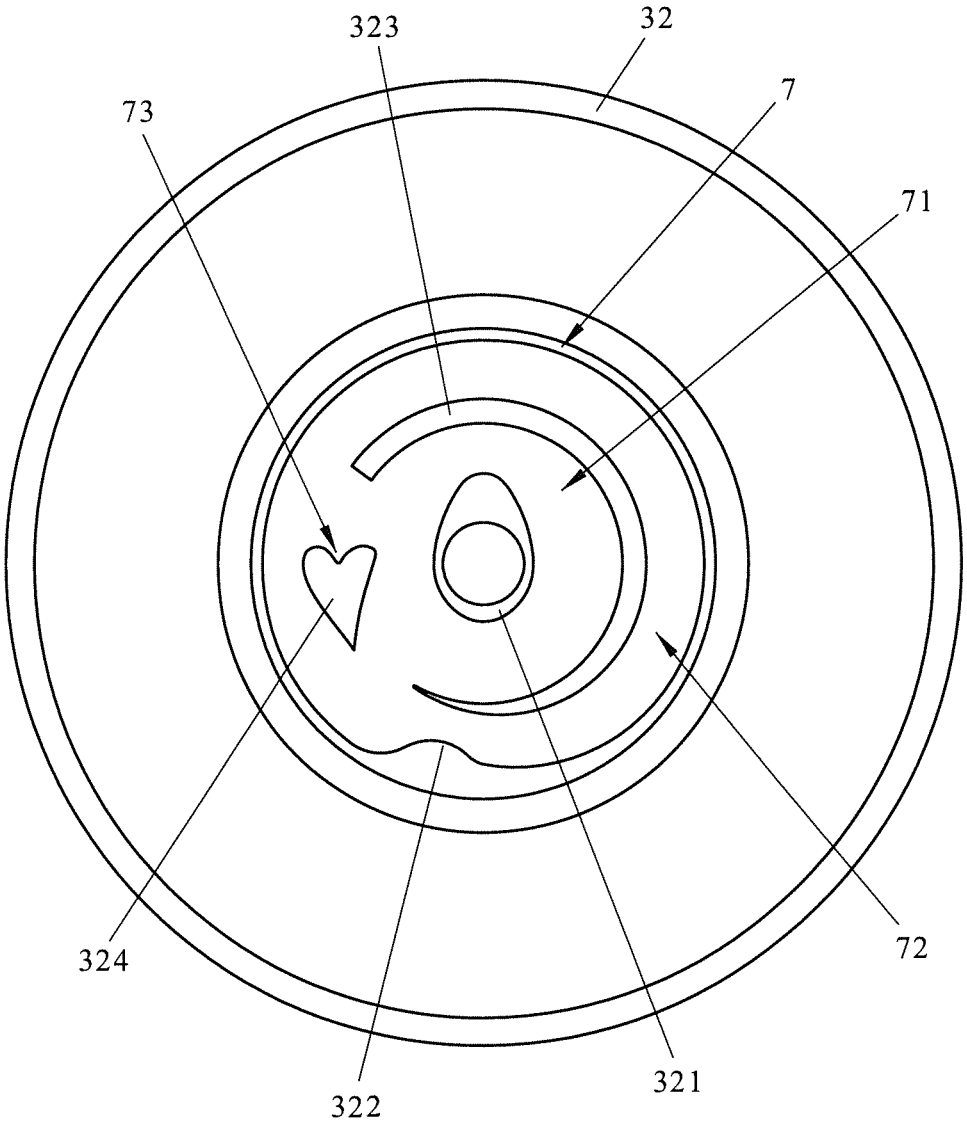
FIG. 5 is a bottom view of FIG. 4.
Figure 6A:
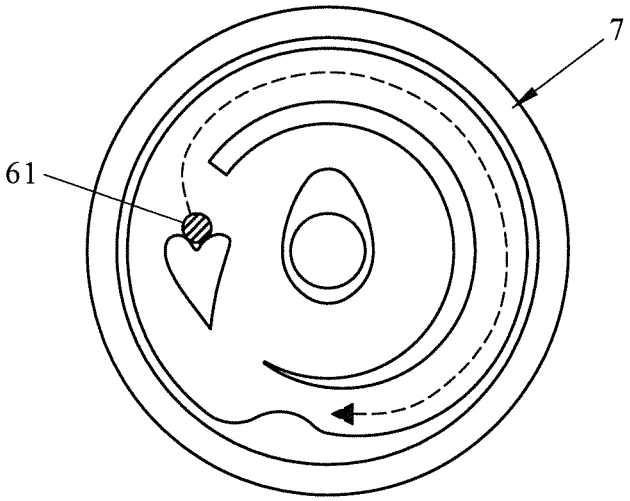
FIGS. 6A and 6B are schematic illustrations showing moving tracks of a tongue member in a planar track when the universal reel device according to the first embodiment of the invention operates from an initial state to an automatic reel-in state.
Figure 6B:
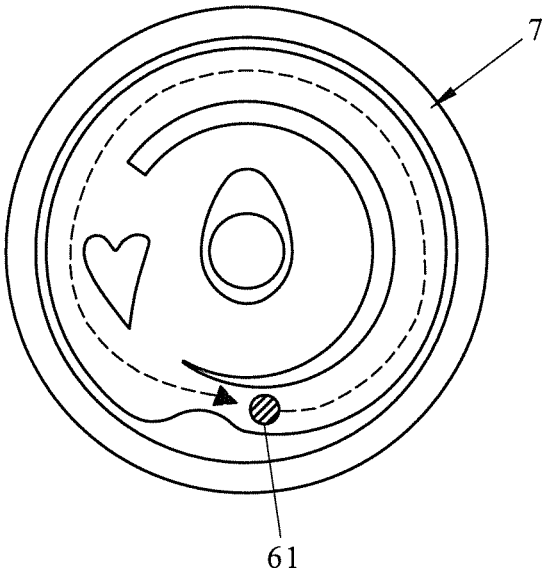
Figure 7A:
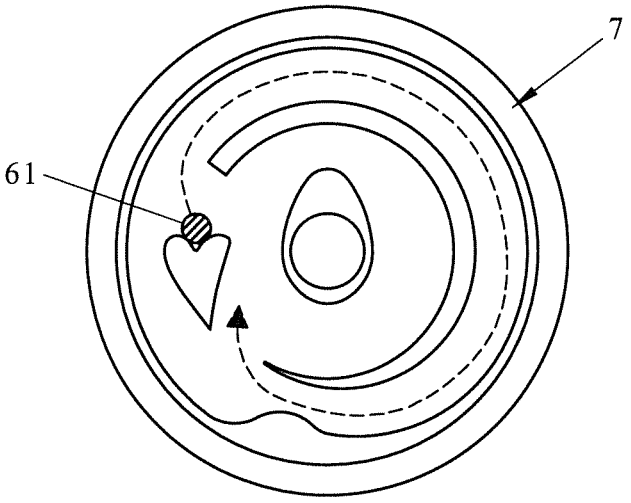
FIGS. 7A and 7B are schematic illustrations showing moving tracks of the tongue member in a planar track when the universal reel device according to the first embodiment of the invention operates from a cable winding state to a cable releasing state.
Figure 7B:
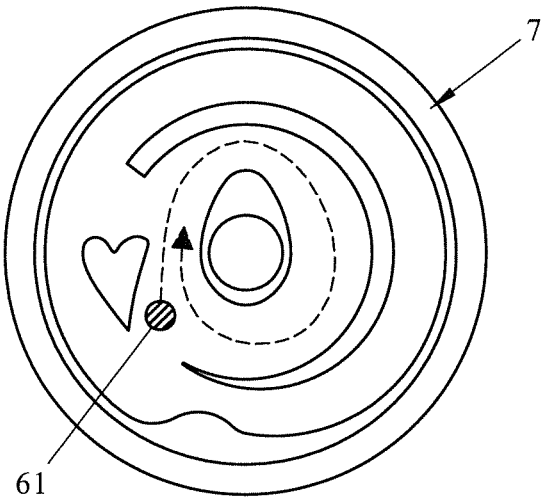
Figure 8:
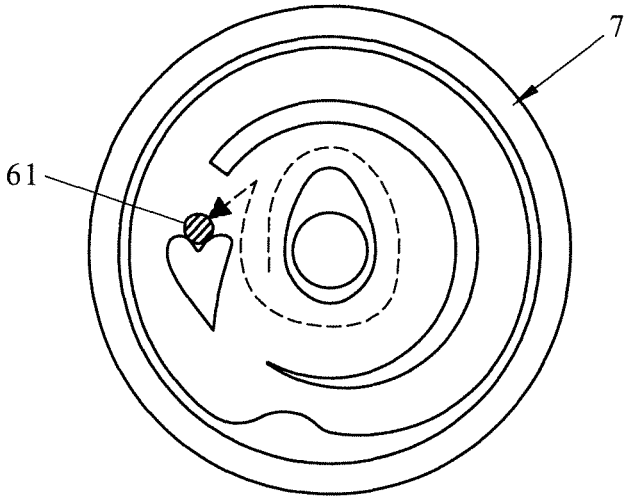
FIG. 8 is a schematic illustration showing moving tracks of the tongue member in a planar track when the universal reel device according to the first embodiment of the invention operates from the cable releasing state to a cable positioning state.
Figure 9:
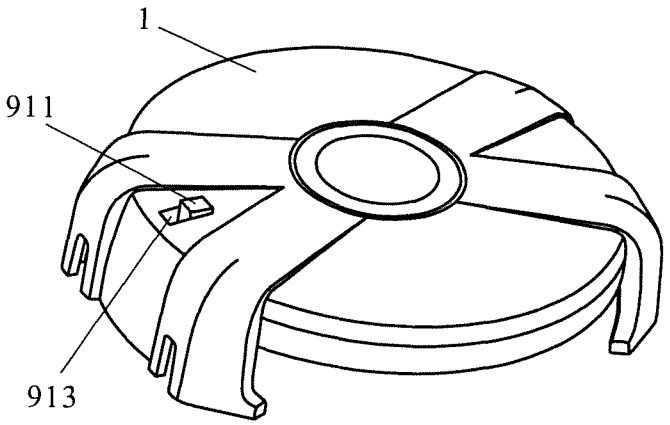
FIG. 9 is a schematic illustration showing structures of an upper cover and a safety switch of the universal reel device according to the first embodiment of the invention.
Figure 10:
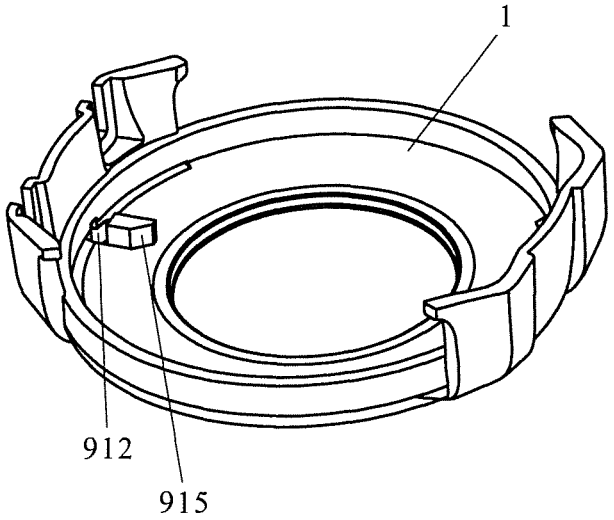
FIG. 10 is a schematic illustration showing the structure of FIG. 9 at another viewing angle.

The cable reeling working principle of the universal reel device of the invention will be described in the following. As shown in FIG. 5, when the spiral spring 4 is in the shrinkage state and the safety switch 9 is in the locked state, the user only needs to hang the cable of the cable product into the cable hooking slot 331 through the opening 5, and then unlocks the safety switch 9 so that the spool 3 can rotate rapidly until the spiral spring 4 returns to its initial state, thereby the cable of the cable product is reeled in. When the safety switch 9 is unlocked, the tongue member 61 engages with the positioning portion 73, and the user only needs to slightly pull the cable or rotate the spool 3 until the tongue member 61 escapes from the positioning portion 73 and moves (hereinafter the relative movement is referred because the rotation of the spool 3 moves the tongue member 61) in the outer ring track 72 but has not entered the inner ring track 71 (see FIG. 6A), the user stops pulling the cable and lets go. Because of the elastic winding force of the spiral spring 4 and the guiding of the edge projection 322, the tongue member 61 always moves in the outer ring track 72 (see FIG. 6B) in the reverse direction. That is, the tongue member 61 is in the automatic reel-in state until the spiral spring 4 returns to its initial state so that the cable is wound around the spool 3, and the cable of the cable product is completely reeled in (i.e., the cable is in the complete reel-in state).

The cable releasing working principle of the universal reel device of the invention will be described in the following. When the cable is wound around the spool 3 and the tongue member 61 engages with the positioning portion 73 (i.e., in the cable winding state), the user unlocks the safety switch 9 and pulls the cable to rotate the spool 3 so that the tongue member 61 escapes from the positioning portion 73 and enters the outer ring track 72 (see FIG. 7A). When the tongue member 61 moves from the outer ring track 72 to the edge projection 322, the tongue member 61 enters the inner ring track 71 with the guidance of the edge projection 322. Then, the tongue member 61 continuously moves in the inner ring track 71 (see FIG. 7B) (i.e., in the cable releasing state) until the user stops pulling the cable and lets go. When the user lets go, the elastic winding force of the spiral spring 4 makes the tongue member 61 engage with the positioning portion 73 (see FIG. 8) (i.e., in the cable positioning state), so that the single positioning function is obtained and the user can pull out the cable by the suitable cable length. When the user further pulls the cable, two conditions occur. In the first condition, the user further pulls the cable to be longer and makes the tongue member 61 escape from the positioning portion 73 and enter the inner ring track 71 from the outer ring track 72, and the elastic winding force of the spiral spring 4 makes the tongue member 61 engage with the positioning portion 73 to implement the positioning again similarly until the user stops pulling the cable and lets go. In the second condition, the user further pulls the cable to be shorter to make the tongue member 61 escape from the positioning portion 73 and move in the outer ring track 72. Before the tongue member 61 enters the inner ring track 71, the user stops pulling the cable and lets go.

Similar to the cable reeling working principle, the elastic winding force of the spiral spring 4 makes the tongue member 61 continuously move in the reverse direction of the outer ring track 72 (i.e., in the automatic reel-in state) until the spiral spring 4 returns to its initial state, in which the cable is wound around the spool 3 again.

In the above-mentioned drawings, the dashed lines represent the moving tracks of the tongue member 61.

Preferably, two sides of the opening 5 of the universal reel device of the invention are formed with two cable slots 51. The boundary portions 52 of the two cable slots 51 correspond to the cable distributing disk 33. This structure makes the external cable be reeled in the universal reel device of the invention along the two cable slots 51 more regularly, and also makes the left and right hands of the user control the adjustments of the direction, pulling force and pulling speed of the universal reel device of the invention and the external cable more effectively.

Preferably, a glue stick 23 is disposed on the bottom end of the lower cover 2 of the universal reel device of the invention. The glue stick 23 may be used for printing the brand, mark and the like. Of course, a velcro for adhering an object, a metal sheet for attracting a cable product, such as an earphone, with a magnet, or a magnet sheet for attracting a cable product having a metal interface, such as a USB interface may also be disposed on the bottom end of the lower cover 2. The invention is not particularly restricted to the glue stick 23 used in this embodiment.

Preferably, a hanging object 8 is disposed on the corresponding outer sides of the upper cover 1 and the lower cover 2 (i.e., the outer side of the housing formed by fastening the upper cover 1 and the lower cover 2 together), and an adhesive film 81 is disposed on the surface of the hanging object 8. The adhesive film 81 is a metal sheet for attracting a cable product, such as an earphone, with a magnet, or a magnet sheet for attracting a cable product having a metal interface, such as a USB interface. Two sides of the adhesive film 81 are formed with longitudinal depressed slots 82 for embedding and fixing the cable. In use, the cable product cannot be reeled into the universal reel device of the invention, the exposed cable can be embedded and fixed into the longitudinal depressed slot 82, and the exposed product can be adhered to or attracted to the adhesive film 81. For example, a headset and an USB interface of an earphone may be adhered or attracted to the adhesive film 81, and the exposed cable connected to the headset and the USB interface of the earphone can be embedded and fixed into the longitudinal depressed slot 82.

In this embodiment, the safety switch 9 includes an actuating block 911 and an elastic sheet 912. The upper cover 1 is formed with a placement hole 913, in which the actuating block 911 and the elastic sheet 912 are placed. One end of the elastic sheet 912 rests against an inner wall of the placement hole 913. The other end of the elastic sheet 912 rests against the actuating block 911 so that the initial state of the actuating block 911 is a locked state. The outer side of the convex block 341 of the top layer 34 of the spool 3 is formed with a latch slot 914. The bottom portion of the actuating block 911 is formed with an engaging block 915, which matches with the latch slot 914 and is for latching the spool 3. The top portion of the actuating block 911 projects beyond the placement hole 913. When the initial state of the actuating block 911 is the locked state (i.e., the safety switch 9 is in the locked state), the pushing of the elastic sheet 912 makes the engaging block 915 latch the latch slot 914 of the convex block 341 and thus lock the spool 3 to prevent the spool 3 from rotating. When the user makes the engaging block 915 escape from the latch slot 914 by actuating the top portion of the actuating block 911 (i.e., the safety switch 9 is in the unlocked state), the spool 3 is unlocked and thus can rotate.

According to the structure of the universal reel device of the invention, it is obtained that the universal reel device of the invention can be easily applied to the cable reel. Examples will be described in the following.

Figure 11:
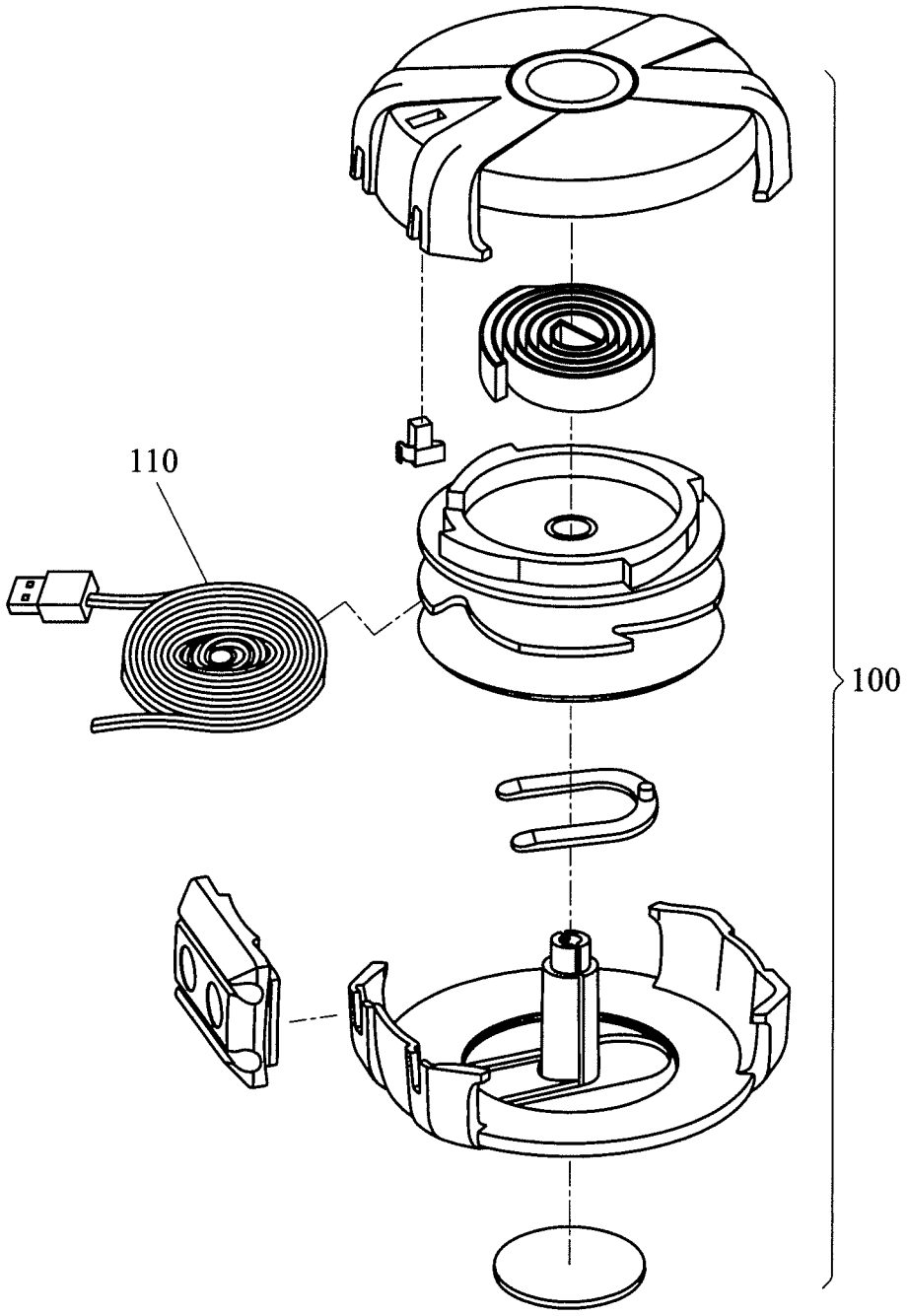
FIG. 11 is a decomposed schematic illustration showing a single-pull reel according to the first embodiment of the invention.

As shown in FIG. 11, this embodiment provides a single-pull reel including a cable 110 and the universal reel device 100. One end of the cable 110 is fixed to the spool 3 of the universal reel device 100, and the other end of the cable 110 is a free end disposed outside the universal reel device 100, so that the free end can be connected to a cable product, such as an earphone, a mouse or the like. The single-pull reel of this embodiment is particularly suitable for the single-pull reel with the single positioning. This safety switch in the universal reel device 100 similarly can enhance the safety of the single-pull reel of this embodiment.

Figure 12:
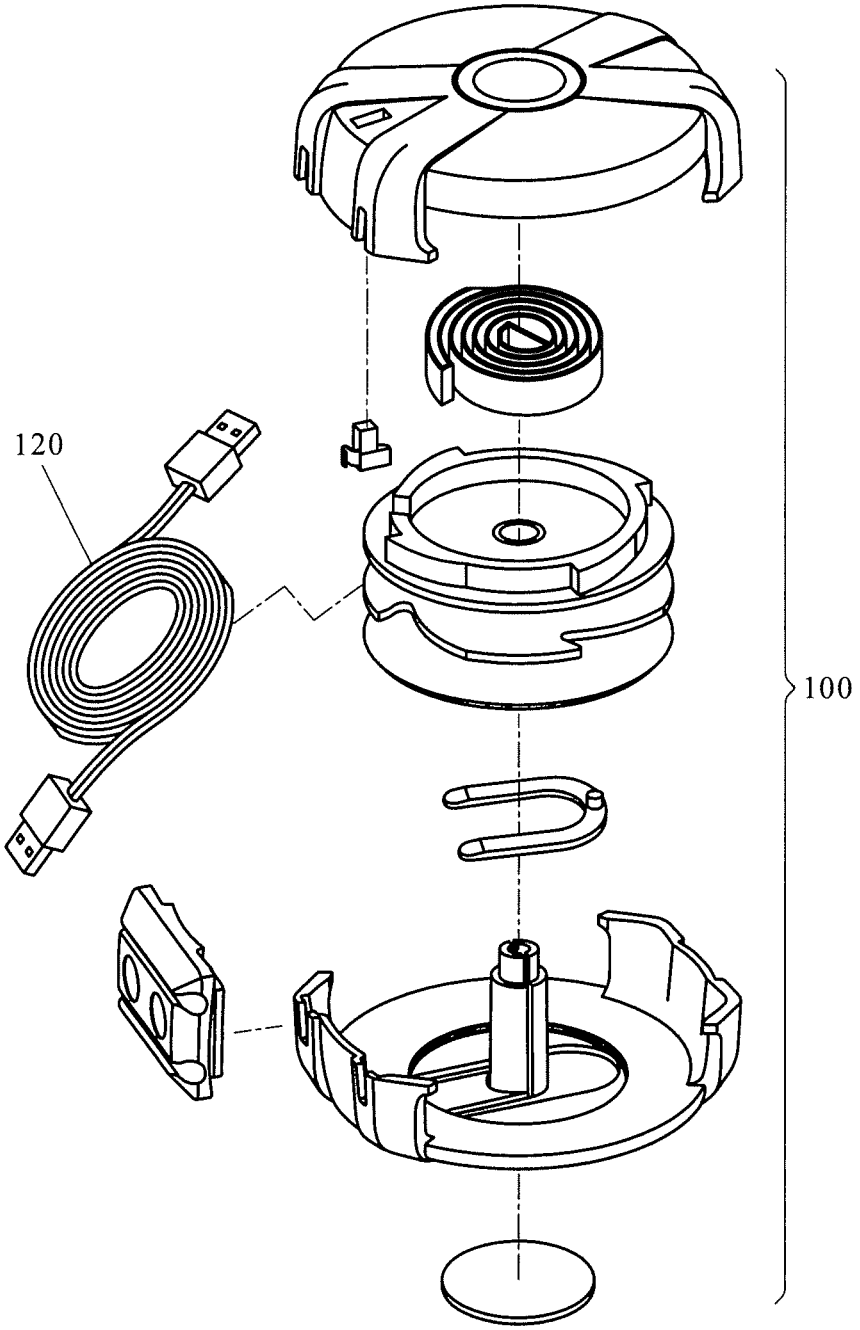
FIG. 12 is a decomposed schematic illustration showing a dual-pull reel according to the first embodiment of the invention.

As shown in FIG. 12, this embodiment further provides a dual-pull reel including a cable 120 and the universal reel device 100. A middle portion of the cable 120 is fixed to the spool 3 of the universal reel device 100, and two ends of the cable 120 are free ends disposed outside the universal reel device 100 so that the free ends can be connected to the cable product, such as the earphone, the mouse or the like. This safety switch in the universal reel device 100 similarly can enhance the safety of the dual-pull reel of this embodiment.

Thus, the application of the universal reel device of the invention to the cable reel should pertain to the protected scope of the invention.

Second Embodiment

Figure 13:
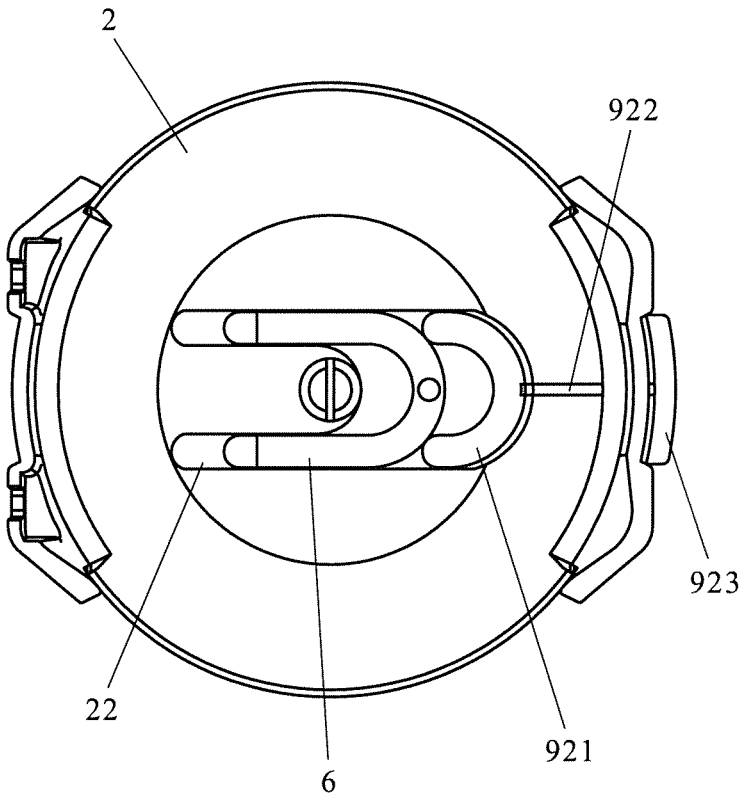
FIG. 13 is a schematic illustration showing structures of a lower cover and a safety switch of a universal reel device according to a second embodiment of the invention.

As shown in FIG. 13, the difference between the universal reel device according to the second embodiment of the invention and that of the first embodiment resides in that the safety switch 9. The safety switch 9 of the universal reel device of this embodiment includes a U-shaped latch 921 and a push-pull portion 923 for latching the U-shaped movable tongue 6. The U-shaped latch 921 is connected to the push-pull portion 923 through a link 922. The U-shaped latch 921 is disposed in the lower cover 2. The push-pull portion 923 is located outside the lower cover 2. The lower cover 2 is formed with a hole through which the link 922 can pass. When the push-pull portion 923 pushes the U-shaped latch 921 into the U-shaped position restricting slot 22, the U-shaped latch 921 latches the U-shaped movable tongue 6 to lock the spool 3 (i.e., the safety switch 9 is in the locked state). When the push-pull portion 923 pulls the U-shaped latch 921 out of the U-shaped position restricting slot 22 (i.e., the safety switch 9 is in the unlocked state), the U-shaped movable tongue 6 can move in the U-shaped position restricting slot 22, so that the spool 3 is unlocked and can rotate.

According to the second embodiment, it is obtained that when the universal reel device of the invention is in the positioning state and if the positioning is to be released to make the spool 3 rotatable, the U-shaped movable tongue 6 definitely slides rightwards (based on the orientation of FIG. 13). Thus, when the universal reel device of the invention is in the positioning state, it is only necessary to place the U-shaped latch 921 on the right side of the U-shaped position restricting slot 22 to push the U-shaped movable tongue 6 so as to lock the tongue member 61 and thus to lock the spool 3. For the placement of the U-shaped latch 921, the U-shaped position restricting slot 22 can be correspondingly lengthened.

The other structures and working principles of the second embodiment are the same as those of the first embodiment, and detailed descriptions thereof will be omitted. The safety switch 9 in each of the first embodiment and the second embodiment may also be mounted in the universal reel device of the invention to form the dual-locking effect and enhance the safety.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A universal reel device, comprising an upper cover, a lower cover, a spool and a spiral spring, wherein the upper cover and the lower cover are fastened together, a center of the lower cover projects upwards to form a shaft, a center of the spool is formed with a through hole matching with the shaft, the shaft is inserted into the through hole so that the spool is rotatably mounted between the upper cover and the lower cover, wherein the spool comprises, from bottom to top, a bottom layer, a middle layer and a top layer, wherein a top portion of the top layer projects upwards to form a convex block for locking the spiral spring, the middle layer is an annular cable distributing disk, the cable distributing disk has a cable hooking slot for hooking a cable, each of an outer side of the upper cover and an outer side of the lower cover is formed with an opening, which is for placement of the cable and corresponds to the cable hooking slot;

a U-shaped movable tongue for positioning is disposed between the bottom layer and the lower cover, an inner side of the lower cover is formed with a U-shaped position restricting slot matching with the U-shaped movable tongue, a middle of an arced path of the U-shaped movable tongue is formed with an upwardly projecting tongue member;

a bottom portion of the bottom layer is formed with a planar track for movement of the projecting tongue member, the projecting tongue member is fit into the planar track so that the spool can drive the projecting tongue member through the planar track and thus drive the U-shaped movable tongue to move in the U-shaped position restricting slot; and the universal reel device further comprises a safety switch for locking the spool.

2. The universal reel device according to claim 1, wherein the planar track comprises an inner ring track, an outer ring track and a positioning portion, which is disposed between the inner ring track and the outer ring track and is for engaging and positioning of the projecting tongue member.

3. The universal reel device according to claim 2, wherein the bottom portion of the bottom layer is formed with a central projection, an edge projection, a partition projection and a positioning projection, which project downwardly to form the planar track; the partition projection is annular to partition off the inner ring track from the outer ring track; the partition projection is formed with a notch, the positioning projection has a heart-like shape, and the positioning projection is located at the notch of the partition projection; and the edge projection is located at a junction between the inner ring track and the outer ring track.

4. The universal reel device according to claim 3, further comprising the cable, wherein one end of the cable is fixed to the spool of the universal reel device, and the other end of the cable is a free end disposed outside the universal reel device.

5. The universal reel device according to claim 3, further comprising the cable, wherein a middle portion of the cable is fixed to the spool of the universal reel device, and two ends of the cable are free ends disposed outside the universal reel device.

6. The universal reel device according to claim 2, further comprising the cable, wherein one end of the cable is fixed to the spool of the universal reel device, and the other end of the cable is a free end disposed outside the universal reel device.

7. The universal reel device according to claim 2, further comprising the cable, wherein a middle portion of the cable is fixed to the spool of the universal reel device, and two ends of the cable are free ends disposed outside the universal reel device.

8. The universal reel device according to claim 1, wherein the safety switch comprises an actuating block and an elastic sheet; the upper cover is formed with a placement hole; the actuating block and elastic sheet are disposed in the placement hole, and one end of the elastic sheet rests against an inner wall of the placement hole; the other end of the elastic sheet rests against the actuating block; an outer side of the convex block of the top layer is formed with a latch slot; a bottom portion of the actuating block is formed with an engaging block, which matches with the latch slot and is for engaging with the spool; and a top portion of the actuating block projects beyond the placement hole.

9. The universal reel device according to claim 8, further comprising the cable, wherein one end of the cable is fixed to the spool of the universal reel device, and the other end of the cable is a free end disposed outside the universal reel device.

10. The universal reel device according to claim 8, further comprising the cable, wherein a middle portion of the cable is fixed to the spool of the universal reel device, and two ends of the cable are free ends disposed outside the universal reel device.

11. The universal reel device according to claim 1, wherein the safety switch comprises a U-shaped latch and a push-pull portion for latching the U-shaped movable tongue, wherein the U-shaped latch is connected to the push-pull portion through a link, the U-shaped latch is disposed in the lower cover, the push-pull portion is disposed outside the lower cover, the lower cover is formed with a hole through which the link passes; and when the push-pull portion pushes the U-shaped latch into the U-shaped position restricting slot, the U-shaped latch latches the U-shaped movable tongue to lock the spool.

12. The universal reel device according to claim 11, further comprising the cable, wherein one end of the cable is fixed to the spool of the universal reel device, and the other end of the cable is a free end disposed outside the universal reel device.

13. The universal reel device according to claim 11, further comprising the cable, wherein a middle portion of the cable is fixed to the spool of the universal reel device, and two ends of the cable are free ends disposed outside the universal reel device.

14. The universal reel device according to claim 1, wherein two sides of the opening are formed with two cable slots having boundary portions corresponding to the cable distributing disk.

15. The universal reel device according to claim 14, further comprising the cable, wherein one end of the cable is fixed to the spool of the universal reel device, and the other end of the cable is a free end disposed outside the universal reel device.

16. The universal reel device according to claim 14, further comprising the cable, wherein a middle portion of the cable is fixed to the spool of the universal reel device, and two ends of the cable are free ends disposed outside the universal reel device.

17. The universal reel device according to claim 1, wherein a glue stick, a velcro, a metal sheet or a magnet sheet is disposed on a bottom end of the lower cover.

18. The universal reel device according to claim 17, further comprising the cable, wherein one end of the cable is fixed to the spool of the universal reel device, and the other end of the cable is a free end disposed outside the universal reel device.

19. The universal reel device according to claim 17, further comprising the cable, wherein a middle portion of the cable is fixed to the spool of the universal reel device, and two ends of the cable are free ends disposed outside the universal reel device.

20. The universal reel device according to claim 1, wherein a hanging object is disposed on corresponding outer sides of the upper cover and the lower cover, wherein an adhesive film is disposed on a surface of the hanging object, the adhesive film is a metal sheet or a magnet sheet, and two sides of the adhesive film are formed with longitudinal depressed slots for embedding and fixing the cable.

21. The universal reel device according to claim 20, further comprising the cable, wherein one end of the cable is fixed to the spool of the universal reel device, and the other end of the cable is a free end disposed outside the universal reel device.

22. The universal reel device according to claim 20, further comprising the cable, wherein a middle portion of the cable is fixed to the spool of the universal reel device, and two ends of the cable are free ends disposed outside the universal reel device.

23. The universal reel device according to claim 1, further comprising the cable, wherein one end of the cable is fixed to the spool of the universal reel device; and the other end of the cable is a free end disposed outside the universal reel device.

24. The universal reel device according to claim 1, further comprising the cable, wherein a middle portion of the cable is fixed to the spool of the universal reel device, and two ends of the cable are free ends disposed outside the universal reel device.

* * * * *